US010586664B2

(12) United States Patent
Yeh et al.

(10) Patent No.: US 10,586,664 B2
(45) Date of Patent: Mar. 10, 2020

(54) LUMINOUS KEYBOARD

(71) Applicant: Primax Electronics Ltd., Taipei (TW)

(72) Inventors: Tien-Yu Yeh, Taipei (TW); Che-Wei Yang, Taipei (TW)

(73) Assignee: PRIMAX ELECTRONICS LTD., Taipei (TW)

( * ) Notice: Subject to any disclaimer, the term of this patent is extended or adjusted under 35 U.S.C. 154(b) by 0 days.

(21) Appl. No.: 16/189,314

(22) Filed: Nov. 13, 2018

(65) Prior Publication Data

US 2019/0172663 A1 Jun. 6, 2019

(30) Foreign Application Priority Data

Dec. 1, 2017 (TW) ..... 106142215 A

(51) Int. Cl.

| | |
|---|---|
| ***H01H 13/83*** | (2006.01) |
| ***H01H 3/12*** | (2006.01) |
| ***H01H 13/7065*** | (2006.01) |
| ***F21V 33/00*** | (2006.01) |
| ***H01H 13/02*** | (2006.01) |

(52) U.S. Cl.

CPC ..... *H01H 13/83* (2013.01); *F21V 33/0004* (2013.01); *H01H 3/125* (2013.01); *H01H 13/023* (2013.01); *H01H 13/7065* (2013.01); *H01H 2219/036* (2013.01); *H01H 2219/054* (2013.01); *H01H 2219/06* (2013.01); *H01H 2219/062* (2013.01)

(58) Field of Classification Search

CPC .. H01H 13/83; H01H 13/023; H01H 2219/06; H01H 2219/062

See application file for complete search history.

(56) References Cited

U.S. PATENT DOCUMENTS

| | | | | |
|---|---|---|---|---|
| 9,214,301 | B2 * | 12/2015 | Chen | H01H 13/83 |
| 9,875,864 | B2 * | 1/2018 | Chih | H01H 13/83 |
| 10,134,543 | B2 * | 11/2018 | Lin | H01H 13/83 |
| 10,236,142 | B2 * | 3/2019 | Tsai | H01H 13/83 |
| 10,312,035 | B2 * | 6/2019 | Chiang | H01H 13/83 |
| 2016/0109636 | A1 * | 4/2016 | Weng | H01H 13/023 362/23.03 |

* cited by examiner

*Primary Examiner* — Felix O Figueroa

(74) *Attorney, Agent, or Firm* — Kirton McConkie; Evan R. Witt

(57) ABSTRACT

A luminous keyboard includes a key module, a light guide plate, a top-view light-emitting element and a light-shading element. The top-view light-emitting element emits a light beam. The light guide plate is located under the key module. The top-view light-emitting element is located under the light guide plate. A light-outputting surface of the top-view light-emitting element is contacted with the light guide plate. The light-shading element is disposed on the light guide plate for shading the light beam. A portion of the light-shading element is inserted into the light guide plate opening and formed as a reflective part in the light guide plate opening. After the light beam is projected on the reflective part and reflected by the reflective part, the light beam is transferred within the light guide plate and projected to the key module.

10 Claims, 5 Drawing Sheets

LUMINOUS KEYBOARD

FIELD OF THE INVENTION

The present invention relates to a keyboard, and more particularly to a luminous keyboard with an illuminating function.

BACKGROUND OF THE INVENTION

Generally, the widely-used peripheral input device of a computer system includes for example a mouse device, a keyboard, a trackball device, or the like. Via the keyboard, characters and symbols can be inputted into the computer system directly. As a consequence, most users and most manufacturers of input devices pay much attention to the development of keyboards.

FIG. 1 is a schematic top view illustrating the outer appearance of a conventional keyboard. As shown in FIG. 1, there are plural keys 10 on a surface of the conventional keyboard 1. These keys 10 are classified into several types, e.g. ordinary keys 101, numeric keys 102 and function keys 103. When one of these keys 10 is depressed by the user's finger, a corresponding signal is issued to the computer, and thus the computer executes a function corresponding to the depressed key. For example, when an ordinary key 101 is depressed, a corresponding English letter or symbol is inputted into the computer. When a numeric key 102 is depressed, a corresponding number is inputted into the computer. In addition, the function keys 103 (F1~F12) can be programmed to provide various functions. For example, the conventional keyboard 1 is a keyboard for a notebook computer.

With the maturity of the computing technologies, the keyboard manufacturers make efforts in designing novel keyboards with special functions in order to meet diversified requirements of different users. For this reason, luminous keyboards are favored by users. Hereinafter, the inner structure of the luminous keyboard will be illustrated in more details. FIG. 2 is a schematic cross-sectional view illustrating a conventional luminous keyboard. As shown in FIG. 2, the conventional luminous keyboard 2 comprises plural key structures 20, a membrane switch circuit member 21, a light guide plate 22, an illumination module 23, a supporting plate 24 and a reflecting plate 25. Each key structure 20 comprises a keycap 201, a scissors-type connecting element 202 and an elastic element 203. From top to bottom, the keycap 201, the scissors-type connecting element 202, the elastic element 203, the membrane switch circuit member 21, the supporting plate 24, the light guide plate 22 and the reflecting plate 25 of the conventional luminous keyboard 2 are sequentially shown. The supporting plate 24 is arranged between the membrane switch circuit member 21 and the light guide plate 22 for supporting the keycap 201, the scissors-type connecting element 202, the elastic element 203 and the membrane switch circuit member 21.

In the key structure 20, the keycap 201 is exposed outside the conventional luminous keyboard 2. Consequently, the keycap 201 can be depressed by the user. The scissors-type connecting element 202 is used for connecting the keycap 201 and the supporting plate 24. The elastic element 203 is penetrated through the scissors-type connecting element 202. In addition, both ends of the elastic element 203 are contacted with the keycap 201 and the membrane switch circuit member 21, respectively. The membrane switch circuit member 21 comprises an upper wiring board 211, a separation layer 212, and a lower wiring board 213. The upper wiring board 211 comprises plural upper conductive parts 2111. The separation layer 212 is located under the upper wiring board 211. Moreover, the separation layer 212 comprises plural separation layer openings 2121 corresponding to the plural upper conductive parts 2111. The lower wiring board 213 is located under the separation layer 212. Moreover, the lower wiring board 213 comprises plural lower conductive parts 2131 corresponding to the plural upper conductive parts 2111. Moreover, plural key switches 214 are defined by the plural lower conductive parts 2131 and the plural upper conductive parts 2111 collaboratively. The upper wiring board 211, the separation layer 212 and the lower wiring board 213 are all made of a light-transmissible material. The light-transmissible material is for example polycarbonate (PC) or polyethylene (PE). Consequently, the upper wiring board 211, the separation layer 212 and the lower wiring board 213 are light-transmissible.

The illumination module 23 comprises an illumination circuit board 231 and plural side-view light-emitting elements 232. For clarification and brevity, only two side-view light-emitting elements 232 are shown in the drawing. The illumination circuit board 231 is located under the membrane switch circuit member 21 for providing electric power to the plural side-view light-emitting elements 232. The plural side-view light-emitting elements 232 are disposed on the illumination circuit board 231. In addition, the side-view plural light-emitting elements 232 are inserted into corresponding reflecting plate openings 251 of the reflecting plate 25 and corresponding light guide plate openings 221 of the light guide plate 22, respectively. By acquiring the electric power, the plural side-view light-emitting elements 232 are driven to emit plural light beams B. Moreover, the plural light beams B are introduced into the light guide plate 22. The light guide plate 22 is used for guiding the plural light beams B to the keycaps 201. The reflecting plate 25 is located under the light guide plate 22 for reflecting the plural light beams B. Consequently, the plural light beams B are directed upwardly, and the utilization efficiency of the light beams B is enhanced.

In the conventional luminous keyboard 2, each keycap 201 has a light-outputting zone 2011. The light-outputting zone 2011 is located at a character region or a symbol region of the keycap 201. Moreover, the position of the light-outputting zone 2011 is aligned with the position of a corresponding light-guiding dot 223 of the light guide plate 22. The light beams can be guided upwardly to the light-outputting zone 2011 by the corresponding light-guiding dot 223. After the plural light beams B are transferred within the light guide plate 22 and projected on the light-guiding dots 223, the light beams B are guided by the light-guiding dots 223 and projected upwardly. The upwardly-projected portions of the light beams B are sequentially transmitted through plural supporting plate openings 241 of the supporting plate 24 and the membrane switch circuit member 21 and transmitted through the plural light-outputting zones 2011 of the keycaps 201 so as to illuminate the character regions or the symbol regions of the keycaps 201. Under this circumstance, the illuminating function is achieved.

However, the conventional luminous keyboard 2 still has some drawbacks. For example, since the side-view light-emitting element 232 is thicker than the light guide plate 22, a portion of the light beam generated by the side-view light-emitting element 232 is not introduced into the light guide plate 22. Since a portion of the light beam is not utilized, the illuminating efficiency of the conventional luminous keyboard 2 is impaired.

Therefore, there is a need of providing a luminous keyboard with enhanced illuminating efficiency.

SUMMARY OF THE INVENTION

An object of the present invention provides a luminous keyboard with enhanced illuminating efficiency.

In accordance with an aspect of the present invention, there is provided a luminous keyboard. The luminous keyboard includes a key module, a light guide plate, a top-view light-emitting element and a light-shading element. The key module is partially exposed outside the luminous keyboard. The light guide plate is located under the key module. The light guide plate includes a light guide plate opening. The top-view light-emitting element is located under the light guide plate. A light-outputting surface of the top-view light-emitting element is contacted with the light guide plate, and the top-view light-emitting element emits a light beam to the light guide plate. The light-shading element is disposed on the light guide plate for shading the light beam. A portion of the light-shading element is inserted into the light guide plate opening and formed as a reflective part in the light guide plate opening. After the light beam is projected on the reflective part and reflected by the reflective part, the light beam is transferred within the light guide plate, transmitted through a perforation of the light-shading element and projected to the key module.

From the above descriptions, the luminous keyboard of the present invention uses the top-view light-emitting element as the light source. Since the light-outputting surface of the top-view light-emitting element is larger than the light-outputting surface of the side-view light-emitting element, the top-view light-emitting element can provide the light beam with higher power. Moreover, the light-outputting surface of the top-view light-emitting element is contacted with the bottom surface of the light guide plate. That is, there is no gap between the top-view light-emitting element and the light guide plate. Since the majority of the light beam is introduced into the light guide plate, the light beam is well utilized. Moreover, a portion of the light-shading element is inserted into the light guide plate opening and formed as the reflective part. After the light beam is reflected by the reflecting part, the light beam is transferred through the light guide plate. The optical path of the light beam for illuminating the luminous keyboard of the present invention is similar to the optical path of the light beam from the conventional side-view light-emitting element. Consequently, the luminous keyboard of the present invention has enhanced illuminating efficiency.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

For overcoming the drawbacks of the conventional technology, the present invention provides a luminous keyboard. The structure of the luminous keyboard will be described as follows.

Figure 1:
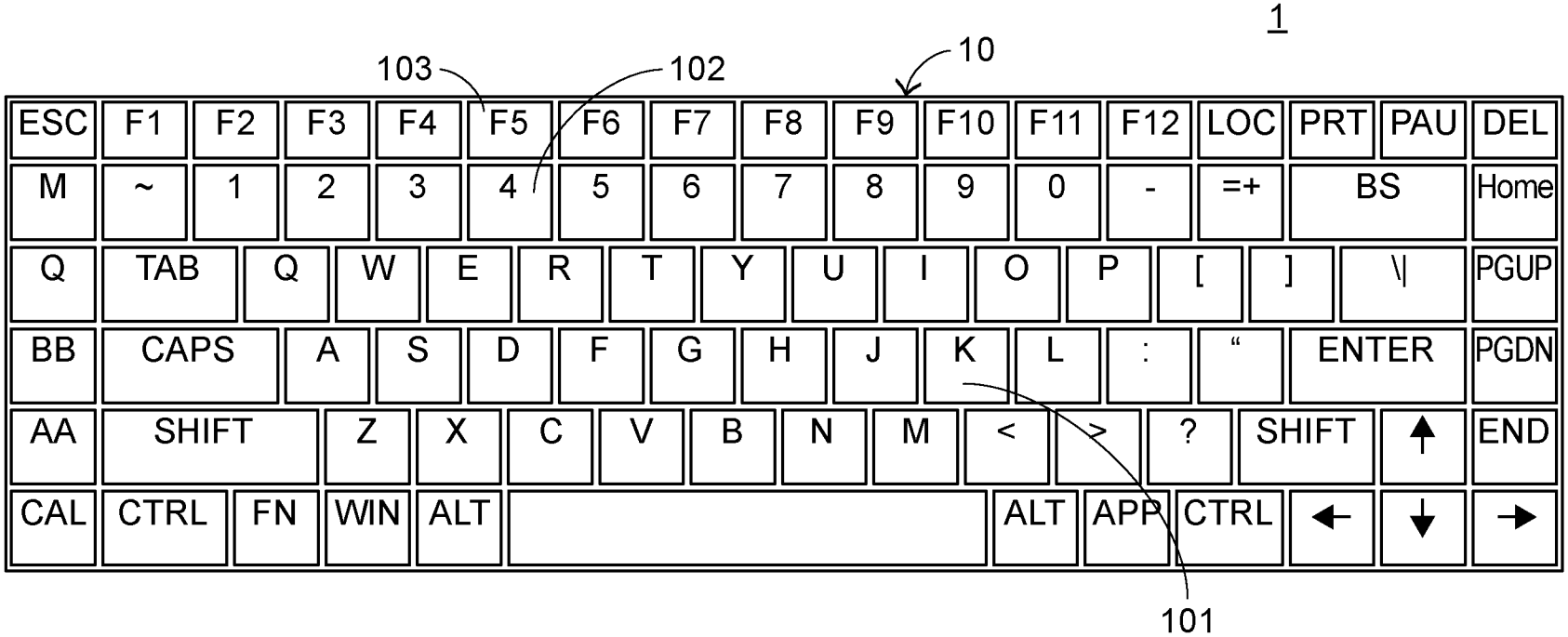
FIG.1 PRIOR ART
FIG. 1 is a schematic top view illustrating the outer appearance of a conventional keyboard.
Figure 2:
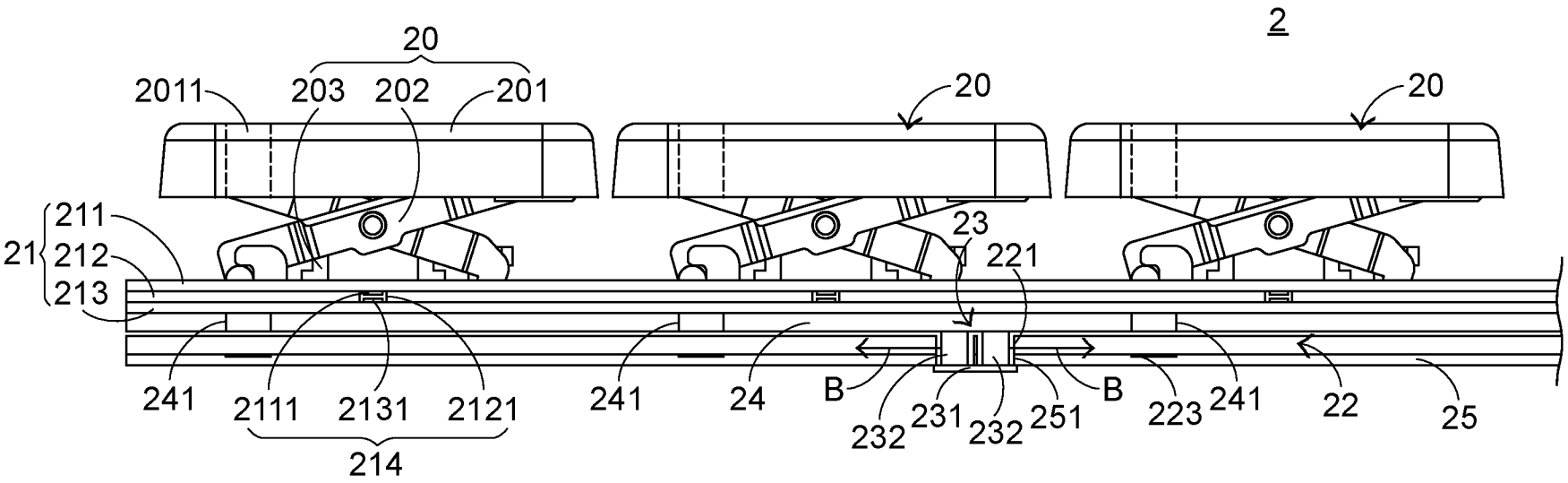
FIG.2 PRIOR ART
FIG. 2 is a schematic cross-sectional view illustrating a conventional luminous keyboard.
Figure 3:
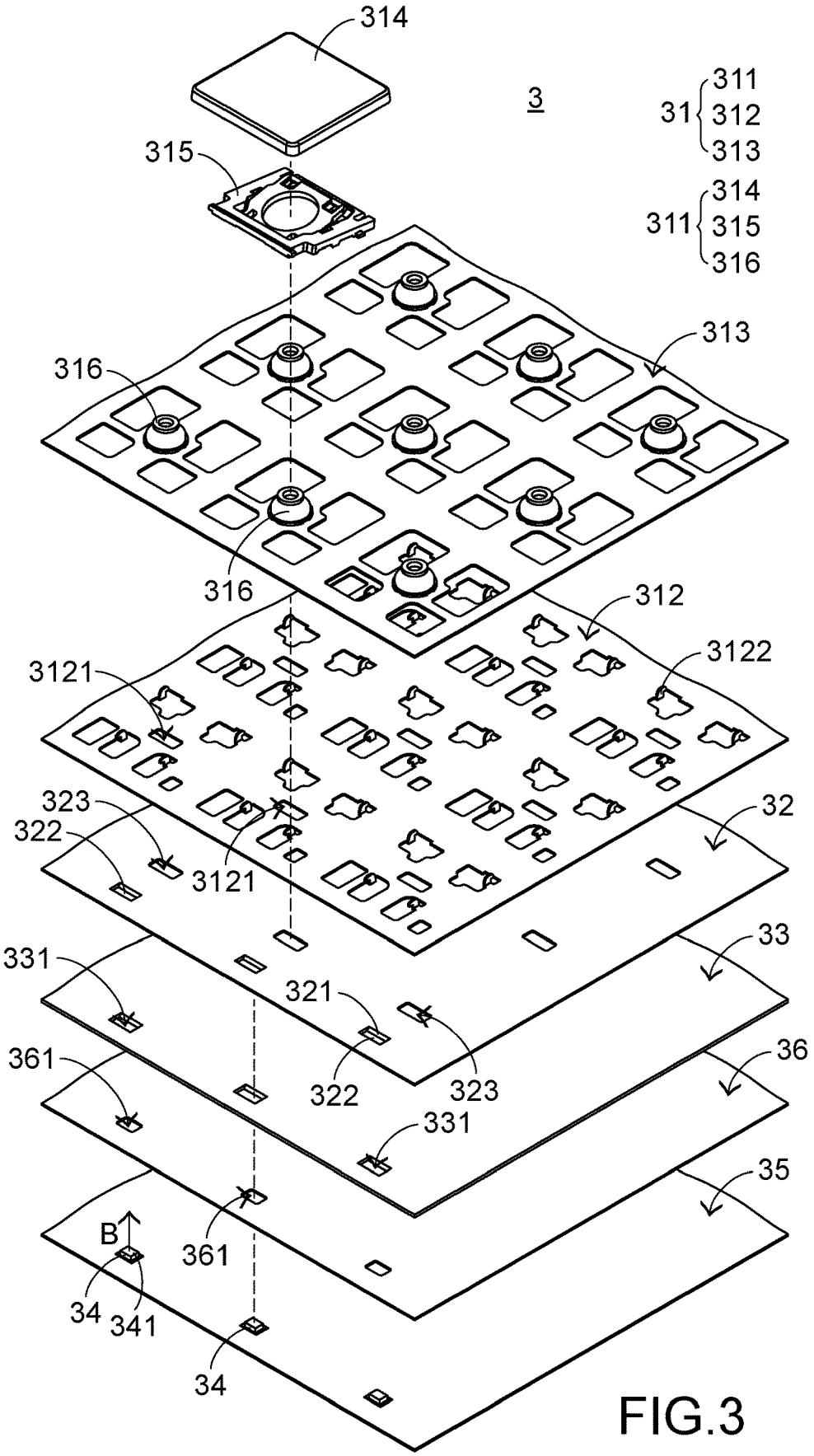
FIG. 3 is a schematic exploded view illustrating a portion of a luminous keyboard according to an embodiment of the present invention.

FIG. 3 is a schematic exploded view illustrating a portion of a luminous keyboard according to an embodiment of the present invention. As shown in FIG. 3, the luminous keyboard 3 comprises a key module 31, a light-shading element 32, a light guide plate 33, plural top-view light-emitting elements 34, an illumination circuit board 35 and a reflecting element 36. The key module 31 comprises plural key structures 311, a supporting plate 312 and a switch circuit board 313. For succinctness, only one key structure 311 is shown in FIG. 3. The light guide plate 33 is located under the key module 31. Moreover, the light guide plate 33 comprises plural light guide plate openings 331 corresponding to the plural top-view light-emitting elements 34. The plural top-view light-emitting elements 34 are located under the light guide plate 33. The light-outputting surfaces 341 of the top-view light-emitting elements 34 are contacted with a bottom surface of the light guide plate 33. The top-view light-emitting elements 34 emit light beams B. The light beams B are introduced into the light guide plate 33 as much as possible. The illumination circuit board 35 is located under the light guide plate 33. The illumination circuit board 35 is located under the light guide plate 33 for supporting the plural top-view light-emitting elements 34. Moreover, the illumination circuit board 35 is electrically connected with the plural top-view light-emitting elements 34. In an embodiment, the plural top-view light-emitting elements 34 are top-view light emitting diodes, and the illumination circuit board 35 is a printed circuit board (PCB) or a flexible printed circuit (FPC).

The reflecting element 36 is arranged between the light guide plate 33 and the illumination circuit board 35. In case that the light beams B are exited from the light guide plate 33, the light beams B are reflected by the reflecting element 36 and introduced into the light guide plate 33 again. Consequently, the utilization efficiency of the light beams B is increased. Preferably, the reflecting element 36 is a reflecting plate or a reflective ink layer. In case that the reflecting element 36 is the reflective ink layer, the reflective ink layer is printed or coated on a bottom surface of the light guide plate 33 or a top surface of the illumination circuit board 35. In case that the reflecting element 36 is the reflecting plate, the reflecting plate comprises plural reflecting plate openings 361. After the plural top-view light-emitting elements 34 are penetrated through the corresponding reflecting plate openings 361, the plural top-view light-emitting elements 34 are inserted into the corresponding light guide plate openings 331.

The plural key structures 311 of the key module 31 are exposed outside the luminous keyboard 3. The supporting plate 312 is arranged between the plural key structures 311 and the light guide plate 33. The supporting plate 312 is connected with the plural key structures 311. Moreover, the supporting plate 312 comprises plural supporting plate openings 3121 and plural hooks 3122. The supporting plate openings 3121 are aligned with the corresponding top-view light-emitting elements 34. The hooks 3122 are aligned with the corresponding key structures 311. The switch circuit board 313 is disposed on the supporting plate 312. When the switch circuit board 313 is triggered by at least one of the plural key structures 311, a corresponding key signal is generated.

Each key structure 311 comprises a keycap 314, a connecting element 315 and a triggering element 316. The keycap 314 is located over the supporting plate 312 and exposed outside the luminous keyboard 3. The connecting element 315 is arranged between the corresponding keycap 314 and the supporting plate 312. The keycap 314 is connected with the supporting plate 312 through the connecting element 315. Consequently, the keycap 314 is movable upwardly or downwardly relative to the supporting plate 312. Particularly, the connecting element 315 is connected with the corresponding keycap 314 and the plural hooks 3122 of the supporting plate 312. The triggering element 316 is arranged between the corresponding keycap 314 and the switch circuit board 313. While the keycap 314 is depressed and moved downwardly to push the triggering element 316, the triggering element 316 is subjected to deformation to trigger the switch circuit board 313. When the keycap 314 is no longer depressed, no external force is applied to the keycap 314. In response to the elasticity of the triggering element 316, the triggering element 316 is restored to its original shape to provide an upward elastic restoring force to the keycap 314. In response to the upward elastic restoring force, the keycap 314 is returned to its original position.

In this embodiment, the triggering element 316 is light-transmissible material. Consequently, the light beams B can pass through the triggering element 316. The connecting element 315 is a scissors-type connecting element. It is noted that the examples of the triggering element and the connecting element are not restricted. In another embodiment, the connecting elements are non-scissors connecting elements for controlling movements of the key structures. For example, a crater-shaped connecting element for a desktop computer is one of the non-scissors connecting elements. In a further embodiment, the keycaps are moved upwardly or downwardly in response to magnetic forces.

Figure 4:
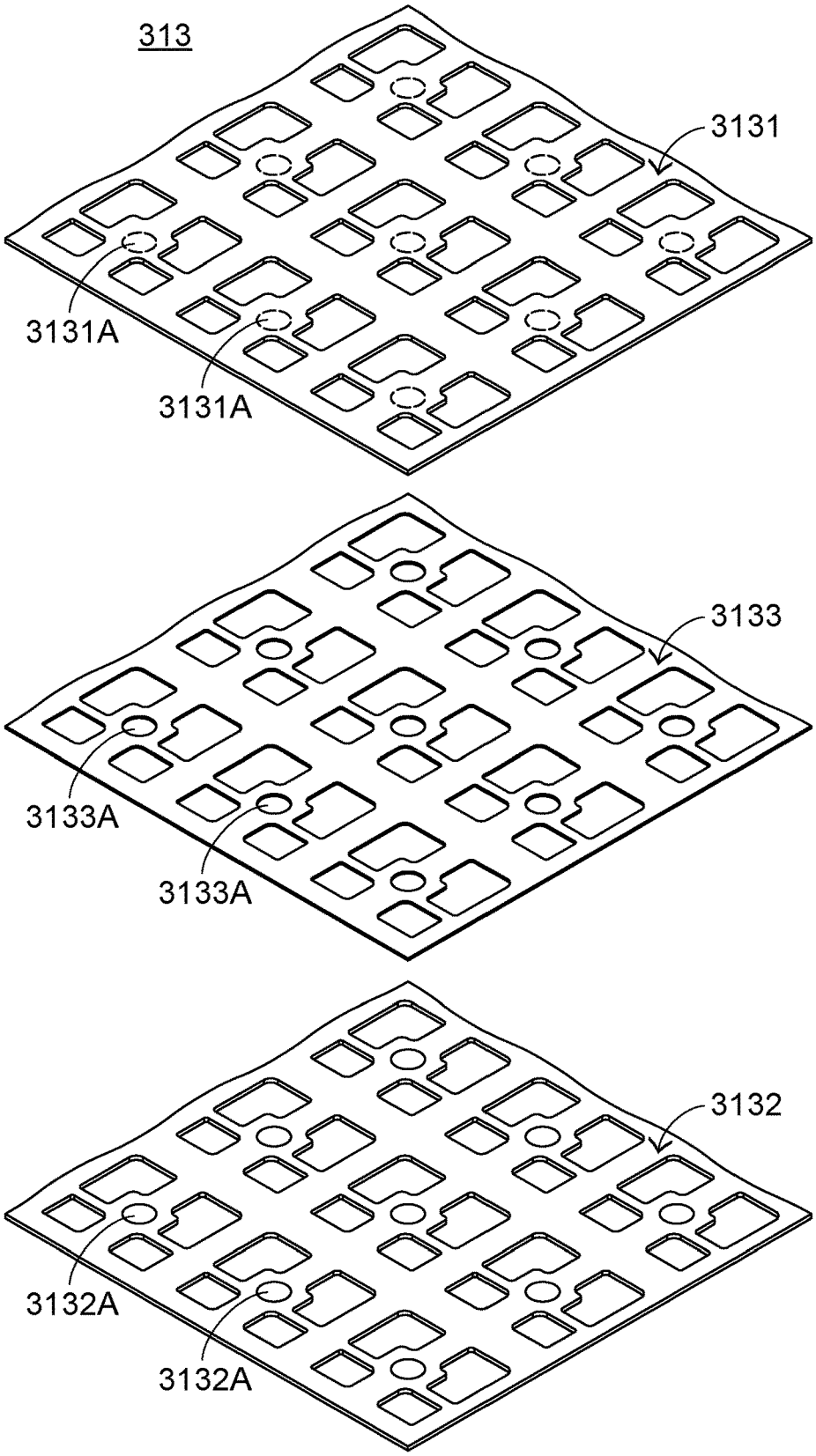
FIG. 4 is a schematic exploded view illustrating the switch circuit board of the luminous keyboard according to the embodiment of the present invention.

FIG. 4 is a schematic exploded view illustrating the switch circuit board of the luminous keyboard according to the embodiment of the present invention. Please refer to FIGS. 3 and 4. The switch circuit board 313 comprises an upper wiring board 3131, a lower wiring board 3132 and a separation layer 3133. The upper wiring board 3131 is contacted with the triggering element 316. Moreover, the upper wiring board 3131 comprises plural upper conductive parts 3131A. The plural upper conductive parts 3131A are disposed on a bottom surface of the upper wiring board 3131. The lower wiring board 3132 is located under the upper wiring board 3131. Moreover, the lower wiring board 3132 comprises plural lower conductive parts 3132A. The plural lower conductive parts 3132A are disposed on a top surface of the lower wiring board 3132. For succinctness, the conductive lines for electrically connecting the conductive parts 3131A and the lower conductive parts 3132A are not shown in FIG. 4. The separation layer 3133 is arranged between the upper wiring board 3131 and the lower wiring board 3132. Moreover, the separation layer 3133 comprises plural separation layer openings 3133A corresponding to the plural keycaps 314. The upper conductive parts 3131A and the plural lower conductive parts 3132A are separated from each other by the separation layer 3133. Moreover, plural key switches (not shown) are defined by the plural upper conductive parts 3131A, the plural separation layer openings 3133A and the plural lower conductive parts 3132A collaboratively. Each key switch is aligned with one key structure 311. When the upper wiring board 3131 is triggered by the triggering element 316, the corresponding upper conductive part 3131A is penetrated through the corresponding separation layer opening 3133A and contacted with the corresponding lower conductive part 3132A. Consequently, the switch circuit board 313 is electrically conducted to generate the corresponding key signal.

In this embodiment, the upper conductive parts 3131A and the lower conductive parts 3132A are circular conductive blocks. It is noted that the examples of the upper conductive parts and the lower conductive parts are not restricted. For example, in some other embodiments, the upper conductive parts and the lower conductive parts are rectangular conductive blocks, triangular conductive blocks or rhombus conductive blocks. In some embodiments, each of the upper conductive parts and the lower conductive parts has a middle light-transmissible region. For example, the rectangular conductive block, the triangular conductive block or the rhombus conductive block has a hollow region that is light-transmissible and located at the middle region of the conductive block. Consequently, the light beam can be transmitted through the hollow region of the conductive block.

Figure 5:
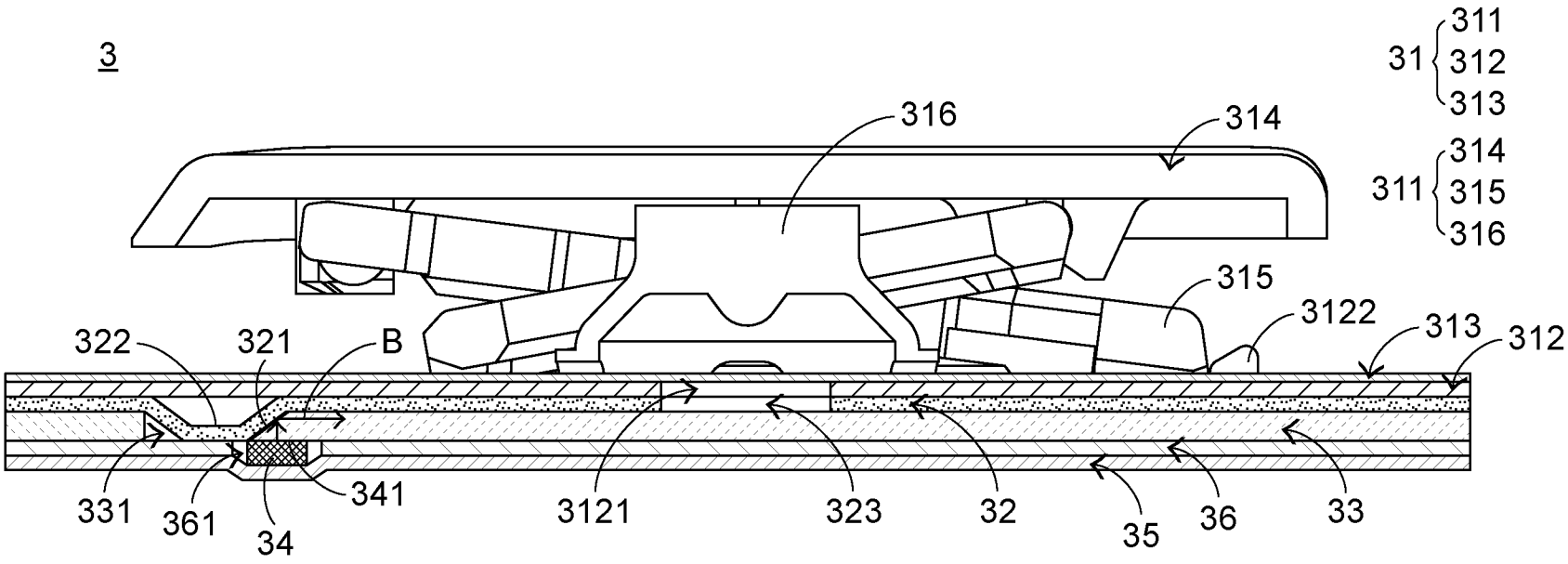
FIG. 5 is a schematic side view illustrating a portion of the luminous keyboard according to the embodiment of the present invention.

FIG. 5 is a schematic side view illustrating a portion of the luminous keyboard according to the embodiment of the present invention. Please refer to FIGS. 3 and 5. The light-shading element 32 is disposed on the light guide plate 33 for shading the light beams B. A portion of the light-shading element 32 is inserted into the plural light guide plate openings 331 and formed as plural reflective parts 321 in the light guide plate openings 331. Moreover, the light-shading element 32 further comprises plural protrusion parts 322 and plural perforations 323. The protrusion parts 322 are aligned with the corresponding light guide plate openings 331, respectively. The perforations 323 are aligned with the corresponding supporting plate openings 3121 and located under the corresponding supporting plate openings 3121. The protrusion parts 322 are inserted into the corresponding light guide plate openings 331. Preferably, the shape of the protrusion part 322 and the shape of the corresponding light guide plate opening 331 are complementary to each other. The reflective part 321 is formed on a lateral surface of the corresponding protrusion part 322. In other words, the light-shading element 32 is stacked on the light guide plate 33 through the plural protrusion parts 322. Preferably, the reflective parts 321 are formed in the corresponding light guide plate openings 331 when the light-shading element 32 and the light guide plate 33 are laminated together. Preferably but not exclusively the reflective part 321 is a reflective layer that is printed or coated on the lateral surface of the corresponding protrusion part 322, and the light-shading element 32 is a light-shading plate. In another embodiment, the light-shading element is made of a reflective material. Under this circumstance, the reflective part is a partial structure of the light-shading element that is inserted into the corresponding light guide plate opening.

After the above components are assembled with each other, the resulting structure of the luminous keyboard is shown in FIG. 5. After the top-view light-emitting elements 34 are driven to emit the light beams B, the light beams B are projected upwardly and introduced into the light guide plate 33. After the light beams B are introduced into the light guide plate 33, the light beams B are projected upwardly and reflected by the reflective parts 321. Consequently, the light beams B are subjected to a total internal reflection within the light guide plate 33. A first portion of the light beams B are transmitted through the perforations 323 of the light-shading element 32, the supporting plate openings 3121 and the switch circuit board 313, and projected to the keycaps 311. Consequently, the illuminating function is achieved. Moreover, a second portion of the light beams B are exited from the light guide plate 33 and reflected by the reflecting element 36. Consequently, the second portion of the light beams B are reflected back into the light guide plate 33 and subjected to the total internal reflection within the light guide plate 33. Under this circumstance, the utilization efficiency of light beams B is enhanced.

In an embodiment, the triggering element 316 is a rubber diffuser. When the light beams B are projected to the triggering element 316, the light beams B are diffused by the triggering element 316. Consequently, the luminance uniformity of the keycap 314 is enhanced. There are two approaches of fabricating the rubber diffuser. In accordance with the first approach, the triggering element 316 is made of a light diffusion material. In accordance with a second approach, the outer surface and/or the inner surface of the triggering element 316 is subjected to a light diffusion surface treatment. Consequently, at least one of the outer surface and the inner surface of the triggering element 316 has the function of diffusing the light beams.

From the above descriptions, the luminous keyboard of the present invention uses the top-view light-emitting element as the light source. Since the light-outputting surface of the top-view light-emitting element is larger than the light-outputting surface of the side-view light-emitting element, the top-view light-emitting element can provide the light beam with higher power. Moreover, the light-outputting surface of the top-view light-emitting element is contacted with the bottom surface of the light guide plate. That is, there is no gap between the top-view light-emitting element and the light guide plate. Since the majority of the light beam is introduced into the light guide plate, the light beam is well utilized. Moreover, a portion of the light-shading element is inserted into the light guide plate opening and formed as the reflective part. After the light beam is reflected by the reflecting part, the light beam is transferred through the light guide plate. The optical path of the light beam for illuminating the luminous keyboard of the present invention is similar to the optical path of the light beam from the conventional side-view light-emitting element. When compared with the conventional luminous keyboard, the light beam provided by the luminous keyboard of the present invention has higher power and the light beam is well utilized. Consequently, the luminous keyboard of the present invention has enhanced illuminating efficiency.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all modifications and similar structures.

What is claimed is:

1. A luminous keyboard, comprising:

a key module partially exposed outside the luminous keyboard;

a light guide plate located under the key module, wherein the light guide plate comprises a light guide plate opening;

a top-view light-emitting element located under the light guide plate, wherein a light-outputting surface of the top-view light-emitting element is contacted with the light guide plate, and the top-view light-emitting element emits a light beam to the light guide plate; and a light-shading element disposed on the light guide plate, and shading the light beam, wherein a portion of the light-shading element is inserted into the light guide plate opening and formed as a reflective part in the light guide plate opening, wherein after the light beam is projected on the reflective part and reflected by the reflective part, the light beam is transferred within the light guide plate, transmitted through a perforation of the light-shading element and projected to the key module.

2. The luminous keyboard according to claim 1, further comprising an illumination circuit board under the light guide plate, wherein the top-view light-emitting element is supported by the illumination circuit board, and the illumination circuit board is electrically connected with the top-view light-emitting element.

3. The luminous keyboard according to claim 2, further comprising a reflecting element between the light guide plate and the illumination circuit board, wherein a portion of the light beam is exited from the light guide plate and reflected by the reflecting element, so that the portion of the light beam is reflected back into the light guide plate.

4. The luminous keyboard according to claim 1, wherein the key module comprises:

plural key structures partially exposed outside the luminous keyboard;

a supporting plate arranged between the plural key structure and the light guide plate, wherein the supporting plate is connected with the plural key structures, and the supporting plate comprises a supporting plate opening; and a switch circuit board disposed on the supporting plate, wherein when the switch circuit board is triggered by one of the plural key structures, a corresponding key signal is generated.

5. The luminous keyboard according to claim 4, wherein each of the plural key structures comprises:

a keycap located over the supporting plate and exposed outside the luminous keyboard;

a connecting element arranged between the keycap and the supporting plate, wherein the keycap is connected with the supporting plate through the connecting element, so that the keycap is movable upwardly or downwardly relative to the supporting plate; and a triggering element arranged between the keycap and the switch circuit board, wherein while the keycap is depressed to push the triggering element, the switch circuit board is triggered by the triggering element.

6. The luminous keyboard according to claim 5, wherein the triggering element is made of a light diffusion material.

7. The luminous keyboard according to claim 5, wherein the switch circuit board comprises:

an upper wiring board contacted with the triggering element, wherein the upper wiring board comprises an upper conductive part;

a lower wiring board located under the upper wiring board, wherein the lower wiring board comprises a lower conductive part; and a separation layer arranged between the upper wiring board and the lower wiring board, wherein the upper conductive part and the lower conductive part are separated from each other by the separation layer, and the separation layer comprises a separation layer opening, wherein when the upper wiring board is triggered by the triggering element, the upper conductive part is penetrated through the separation layer opening and contacted with the lower conductive part, so that the switch circuit board generates the key signal.

8. The luminous keyboard according to claim 7, wherein the light-shading element further comprises a protrusion part corresponding to the light guide plate opening, wherein the protrusion part is inserted into the light guide plate opening, a shape of the protrusion part and a shape of the light guide plate opening are complementary to each other, and the reflective part is formed on a lateral surface of the protrusion part.

9. The luminous keyboard according to claim 8, wherein the reflective part is a reflective layer that is printed or coated on the lateral surface of the protrusion part, and the light-shading element is a light-shading plate.

10. The luminous keyboard according to claim 1, wherein the light-shading element is made of a reflective material, and the reflective part is a partial structure of the light-shading element.

* * * * *